US009666046B2

(12) United States Patent
Lim

(10) Patent No.: US 9,666,046 B2
(45) Date of Patent: May 30, 2017

(54) SURVEILLANCE CAMERA SYSTEM AND METHOD OF CONTROLLING THE SAME

(71) Applicant: HANWHA TECHWIN CO., LTD., Changwon-si (KR)

(72) Inventor: Yong Seob Lim, Changwon-si (KR)

(73) Assignee: Hanwha Techwin Co., Ltd., Changwon-Si (KR)

( * ) Notice: Subject to any disclaimer, the term of this patent is extended or adjusted under 35 U.S.C. 154(b) by 298 days.

(21) Appl. No.: 14/499,792

(22) Filed: Sep. 29, 2014

(65) Prior Publication Data

US 2015/0356841 A1 Dec. 10, 2015

(30) Foreign Application Priority Data

Jun. 10, 2014 (KR) ..... 10-2014-0070273

(51) Int. Cl.
*G08B 13/196* (2006.01)
*G08B 29/04* (2006.01)

(52) U.S. Cl.
CPC ..... *G08B 13/19619* (2013.01); *G08B 29/046* (2013.01); *G08B 13/19689* (2013.01); *G08B 13/19697* (2013.01)

(58) Field of Classification Search
CPC ..... G08B 13/19619; G08B 13/19689; G08B 13/19697; G08B 29/046
USPC ..... 348/143, 373, 207.1; 89/36.03; 160/29, 160/30; 396/25, 427
See application file for complete search history.

(56) References Cited

U.S. PATENT DOCUMENTS 7,465,108 B2 * 12/2008 Brown ..... H04N 7/181 348/143
7,812,882 B2 * 10/2010 Cutler ..... G03B 17/04 348/36
8,384,542 B1 * 2/2013 Merrill ..... G08B 25/004 340/426.1
8,558,889 B2 * 10/2013 Martin ..... G08B 13/19697 348/143
9,202,356 B1 * 12/2015 Kobayashi ..... G08B 13/19619
2002/0158968 A1 * 10/2002 Leitgeb ..... H04N 7/183 348/151

(Continued)

FOREIGN PATENT DOCUMENTS

JP 2000-307922 A 11/2000
KR 10-0495746 B1 6/2005
KR 10-2007-0031079 A 9/2007

*Primary Examiner* — Thai Tran
*Assistant Examiner* — Stephen Smith
(74) *Attorney, Agent, or Firm* — Sughrue Mion, PLLC

(57) ABSTRACT

A surveillance camera is provided. The surveillance camera includes: an imaging assembly; a dome cover included a transparent portion and formed to surround the imaging unit assembly; a shield configured to move along a surface of the dome cover; a shield driver configured to control the shield; and a sensor configured to sense a value corresponding to at least one of whether an object is approaching the surveillance camera, whether the surveillance camera is falling, whether an impact is exerted on the dome cover, and whether a voice signal is input from an outside of the surveillance camera, wherein the sensed value is compared with a preset value, and the shield driver is further configured to control the shield to shield at least a portion of the dome cover based on a result of the comparing.

17 Claims, 6 Drawing Sheets

(56) References Cited

U.S. PATENT DOCUMENTS

| | | | | |
|---|---|---|---|---|
| 2007/0253702 | A1* | 11/2007 | Leyden | G03B 17/00 396/427 |
| 2011/0310293 | A1 | 12/2011 | Yamauchi et al. | |
| 2012/0000024 | A1* | 1/2012 | Layton | G03B 11/00 15/97.1 |
| 2012/0045197 | A1* | 2/2012 | Jones | G03B 17/02 396/427 |
| 2012/0314063 | A1* | 12/2012 | Cirker | G08B 13/19652 348/143 |
| 2013/0209079 | A1* | 8/2013 | Alexander | B60R 11/04 396/25 |
| 2013/0222609 | A1* | 8/2013 | Soffer | G03B 11/043 348/207.1 |
| 2013/0287385 | A1* | 10/2013 | Andersson | H04N 5/2252 396/427 |
| 2014/0002649 | A1* | 1/2014 | Martin | G08B 13/19697 348/143 |
| 2014/0118554 | A1* | 5/2014 | Bucknor | H04N 5/2251 348/155 |
| 2015/0172520 | A1* | 6/2015 | Lindman | H04N 5/2252 382/190 |
| 2015/0268534 | A1* | 9/2015 | Jikihara | G03B 11/00 396/448 |

* cited by examiner

SURVEILLANCE CAMERA SYSTEM AND METHOD OF CONTROLLING THE SAME

CROSS-REFERENCE TO RELATED APPLICATION

This application claims priority from Korean Patent Application No. 10-2014-0070273, filed on Jun. 10, 2014, in the Korean Intellectual Property Office, the disclosure of which is incorporated herein in its entirety by reference.

BACKGROUND

1. Field

Apparatuses and methods consistent with exemplary embodiments relate to a surveillance camera system and a method of controlling the surveillance camera system.

2. Description of the Related Art

A surveillance camera system generally photographs and monitors a wide area by moving a camera unit of the surveillance camera system in a panning motion and a tilting motion.

A panning motion and a tilting motion involve a rotary motion of the camera unit, and to this end, an imaging device includes a rotation support unit and a rotation drive unit.

For the panning motion and the tilting motion, the camera unit of the surveillance camera system is installed in a rotation support unit structure that may rotate relative to a fixed unit, and is configured to receive power from the rotation drive unit, such as a motor, and rotate.

A surveillance camera system of the related art is disclosed in detail in Japanese Registered Patent Publication No. 3342273 (Title: Surveillance Camera Device).

However, because surveillance camera systems are often installed outdoors or in dangerous regions, the surveillance camera systems may be attacked or damaged by a variety of dangerous objects. Accordingly, there is a need to protect the surveillance camera systems.

SUMMARY

One or more exemplary embodiments address at least the above problems and/or disadvantages and other disadvantages not described above. Also, exemplary embodiments are not required to overcome the disadvantages described above, and an exemplary embodiment may not overcome any of the problems described above.

One or more exemplary embodiments include a surveillance camera system and a method of controlling the surveillance camera system.

Additional aspects will be set forth in part in the description which follows and, in part, will be apparent from the description, or may be learned by practice of the exemplary embodiments.

According to an aspect of an exemplary embodiment, there is provided a surveillance camera, including: an imaging assembly; a dome cover including a transparent portion and formed to surround the imaging unit assembly; a shield configured to move along a surface of the dome cover; a shield driver configured to control the shield; and a sensor configured to sense a value corresponding to at least one of whether an object is approaching the surveillance camera, whether the surveillance camera is falling, whether an impact is exerted on the dome cover, and whether a voice signal is input from outside of the surveillance camera, wherein the sensed value is compared with a preset value, and wherein the shield driver is further configured to control the shield to shield at least a portion of the dome cover based on a result of the comparing.

The shield driver may include: a rack gear connected with the shield; a pinion gear engaged with the rack gear and configured to rotate; and a driver connected with the pinion gear and configured to rotate the pinion gear.

The shield driver may be further configured to control the shield to shield at least a portion of the dome cover in response to the sensed value being equal to or greater than the preset value.

The surveillance camera may further include an alarm configured to output an alarm to the outside based on the sensed value.

The sensor may include a laser sensor configured to sense whether the object is approaching the surveillance camera.

The shield may be formed of an elastic material.

The shield may be formed in a ring shape.

The surveillance camera may further include a controller configured to store the preset value, compare the sensed value with the preset value, and control the shield driver based on the result of the comparing.

According to an aspect of another exemplary embodiment, there is provide a surveillance camera, including: an imaging assembly; a dome cover including a transparent portion and formed to surround the imaging assembly; a shield configured to move along a surface of the dome cover; and a shield driver configured to control the shield to shield at least a portion of the dome cover based on a result of comparing data acquired by the imaging assembly with preset data.

The shield may be formed of an elastic material.

The shield may be formed in a ring shape.

The surveillance camera may further include a controller configured to store the preset data, compare the data acquired by the imaging assembly with the preset data, and control the shield driver based on the result of the comparing.

According to an aspect of another exemplary embodiment, there is provided a method of controlling a surveillance camera, the method including: generating data by at performing at least one of: photographing an area in which the surveillance camera is disposed; and sensing at least one of whether an object is approaching the surveillance camera, whether the surveillance camera is falling, whether an impact is exerted on a dome cover of the surveillance camera, and whether a voice signal input from the area in which the surveillance camera is disposed; comparing the generated data with preset data; and in response to the generated data being equal to or greater than the preset data, operating a shield driver to protect the dome cover with a shield.

The generated data may be from the group consisting of an acquired image, an acquired video, an acceleration value, an angular speed, a speed value, an impact value, and a voice signal.

According to an aspect of another exemplary embodiment, there is provided a camera including: a camera module; a shield configured to protect the camera module; and a controller configured to control the shield to protect the camera module in response to determining that a predetermined event occurs.

The camera may further include: a dome cover including a transparent portion and formed to surround the camera module; and a shield driver configured to move the shield based on a signal received from the controller.

The predetermined event may include at least one of an object approaching the camera, the camera falling, an impact exerted on the dome cover, and a received voice command.

The shield may be configured to move along the dome cover.

The shield may be formed of an elastic material.

BRIEF DESCRIPTION OF THE DRAWINGS

These and/or other aspects will become apparent and more readily appreciated from the following description of exemplary embodiments, taken in conjunction with the accompanying drawings in which.

DETAILED DESCRIPTION

Figure 1:
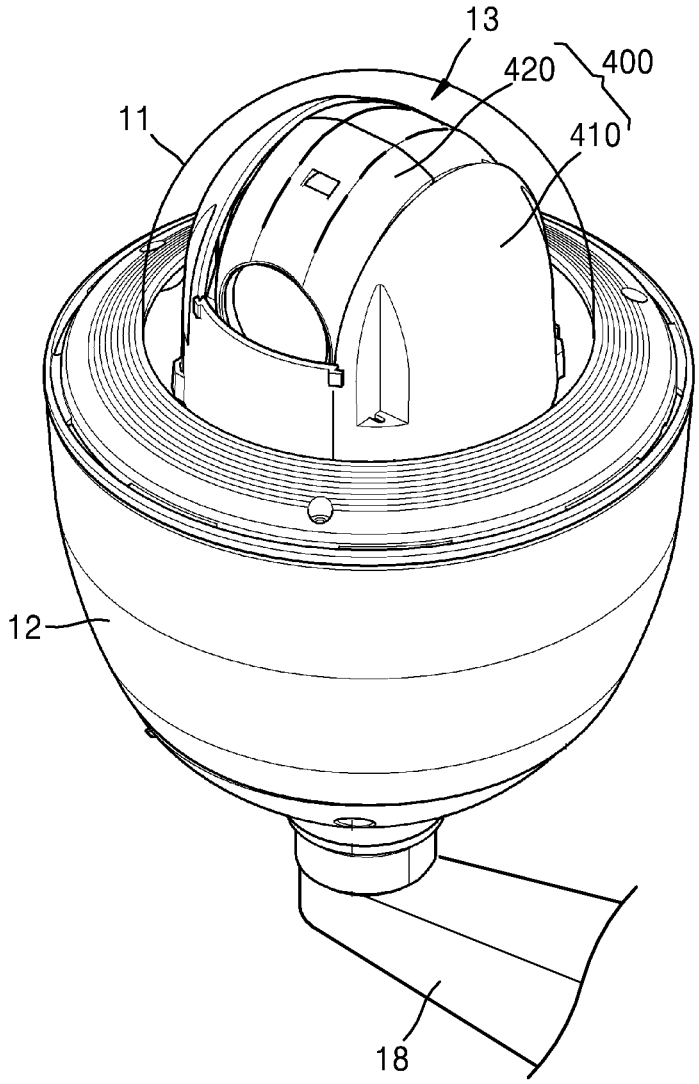
FIG. 1 is a perspective view of a surveillance camera system according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. The present inventive concept is defined solely by the scope of the claims. Meanwhile, the terminology used in this specification is used to describe particular exemplary embodiments and does not limit the present inventive concept. As used herein, an expression in the singular includes an expression in the plural unless they are clearly different from each other in context. In this specification, terms, such as "include" and "have", are used to indicate the existence of features, numbers, steps, operations, elements, parts, or combinations thereof mentioned herein without excluding in advance the possibility of existence or addition of one or more other features, numbers, steps, operations, elements, parts, or combinations thereof. Although terms, such as "first" and "second", may be used to describe various elements, the elements are not limited by these terms. These terms are only used to differentiate one element from another element.

Figure 2:
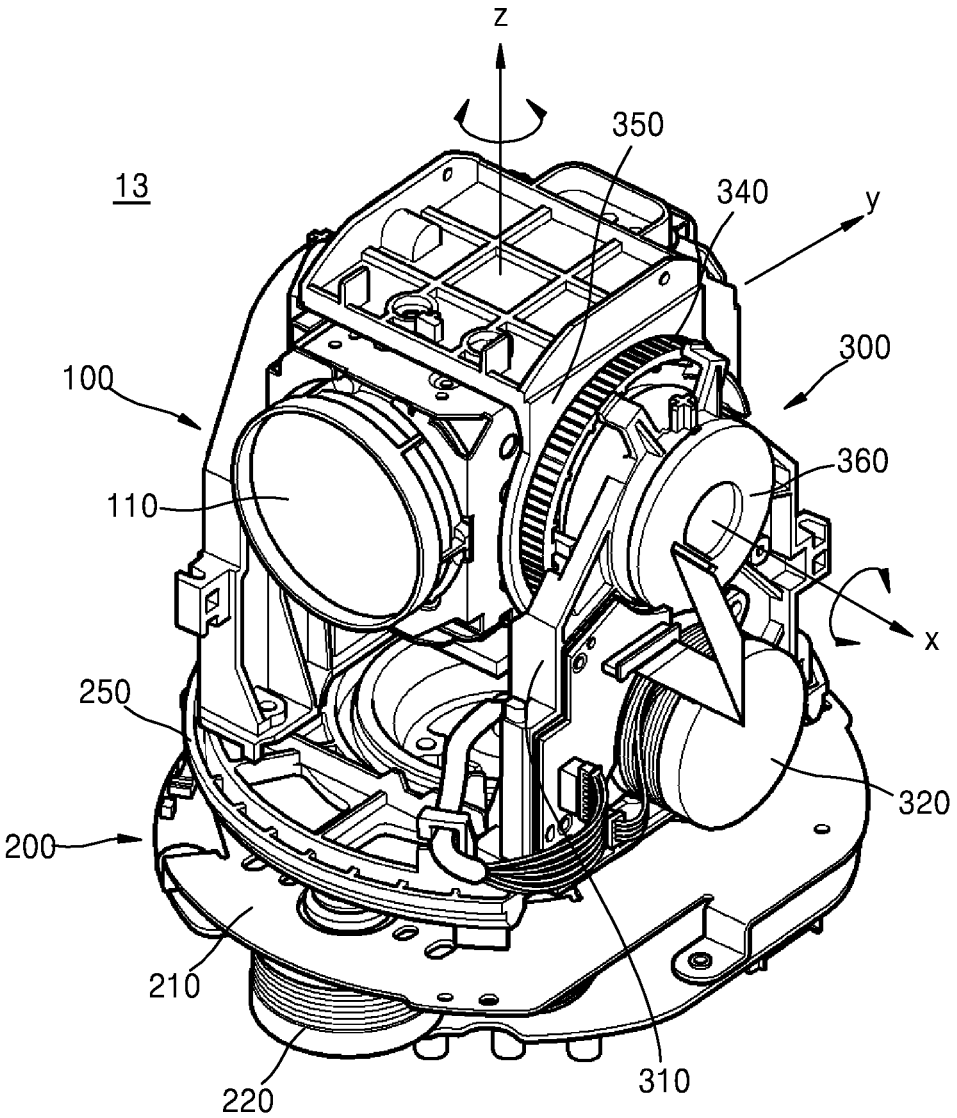
FIG. 2 is a perspective view of an imaging unit assembly of the surveillance camera system shown in FIG. 1.
Figure 3:
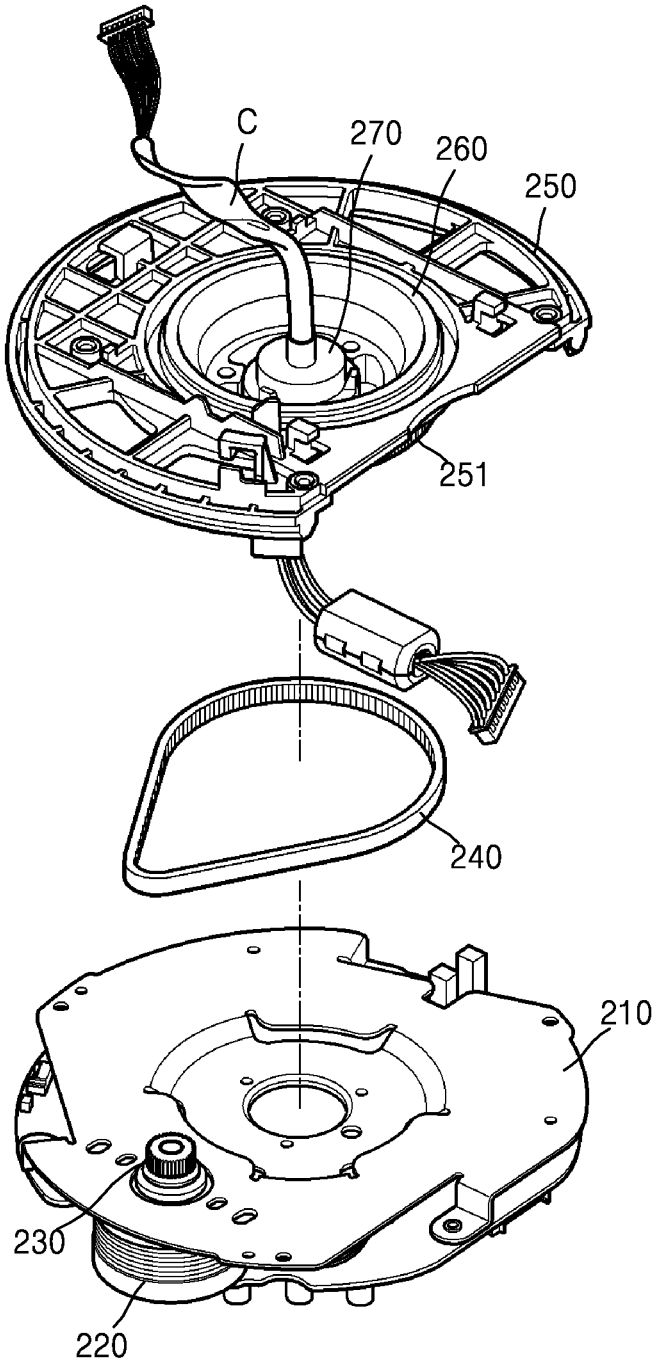
FIG. 3 is an exploded perspective view of a rotation support assembly for panning shown in FIG. 2.
Figure 4:
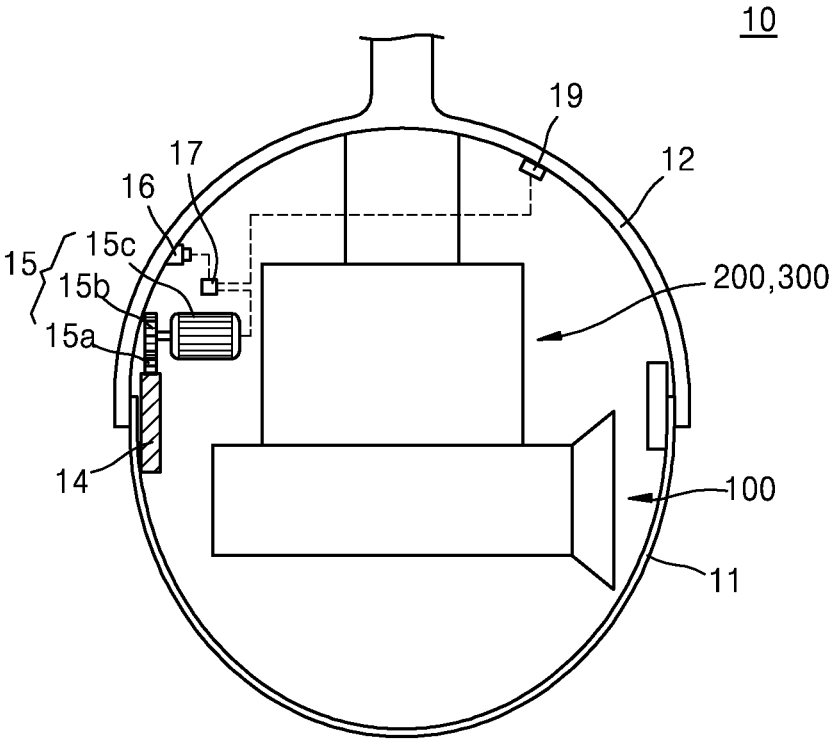
FIG. 4 is a conceptual diagram of the surveillance camera system shown in FIG. 1.
Figure 5:
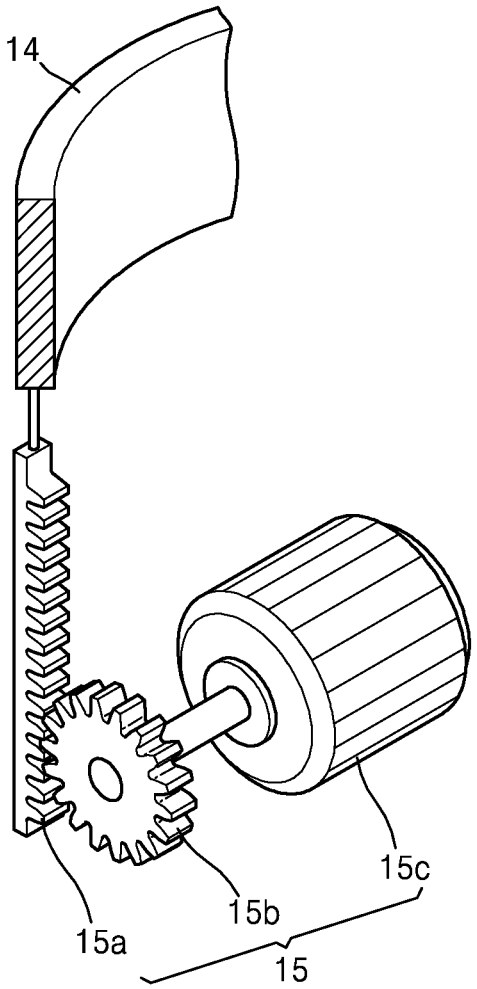
FIG. 5 is a perspective view of a shield driver shown in FIG. 4.

FIG. 1 is a perspective view of a surveillance camera system according to an exemplary embodiment. FIG. 2 is a perspective view of an imaging unit assembly of the surveillance camera system shown in FIG. 1. FIG. 3 is an exploded perspective view of a rotation support assembly for panning shown in FIG. 2. FIG. 4 is a conceptual diagram of the surveillance camera system shown in FIG. 1. FIG. 5 is a perspective view of a shield driver shown in FIG. 4.

Referring to FIGS. 1 to 5, a surveillance camera system 10 may include an imaging unit assembly 13, a dome cover 11, a shield unit 14, a shield driver 15, a sensor unit 16 (i.e., sensor), a controller 17, a fixing unit 18, and an alarm 19.

The dome cover 11 is formed of a light-transmitting material that imaging light may pass through. For example, the light-transmitting material may be glass or a plastic material, but is not limited thereto.

The dome cover 11 may have a hemispherical shape, and is installed in a body 12.

The imaging unit assembly 13 is installed in the body 12, and the dome cover 11 is installed under the body 12 as described above.

The imaging unit assembly 13 is a device that performs photography, and a camera module 100 is installed in the imaging unit assembly 13. The camera module 100 will be described in further detail later.

The fixing unit 18 fixes the body 12 to a structure, so that the body 12 is installed. For example, the structure may be a wall, a ceiling, a column, etc., but is not limited thereto.

Although the surveillance camera system 10 is shown as a dome-type surveillance camera system, exemplary embodiments are not limited to a dome-type surveillance camera system. In other words, a surveillance camera system according to an exemplary embodiment may be a camera system other than a dome-type camera system.

The imaging unit assembly 13 includes the camera module 100, a rotation support assembly 200 for panning, a rotation support assembly 300 for tilting, and a cover assembly 400.

In the camera module 100, an optical system 110 and an imaging device (not shown), such as a charge coupled device (CCD), are disposed so that the camera module 100 may be configured to photograph or monitor a subject.

The camera module 100 is configured to rotate about a z-axis through a panning motion and rotate about an x-axis through a tiling motion.

The rotation support assembly 200 for panning performs a function of supporting the camera module 100 so that the camera module 100 may rotate about the z-axis. The rotation support assembly 200 for panning includes a first assembly fixing unit 210, a first drive motor 220, a first drive pulley 230, a first belt 240, a first rotation support unit 250, a first rotation axis unit 260, and a first slip ring 270.

The first assembly fixing unit 210 is fixedly installed in the body 12, and has a plate shape.

The first drive motor 220 is installed on one side of the first assembly fixing unit 210 and is a driving source for the panning motion. The first drive motor 220 may be a step motor, a direct current (DC) motor, a servo motor, etc.

The first drive motor 220 is instructed by the controller 17 (not shown) to perform a function of rotating the first rotation support unit 250.

The first drive pulley 230 is installed on the rotor of the first drive motor 220, and rotates the first belt 240 installed on the first drive pulley 230. In the present exemplary embodiment, the first belt 240 is formed as a timing belt having an inner surface on which teeth are formed, and thus a timing belt pulley is used as the first drive pulley 230.

Although the first belt 240 is implemented a timing belt in the present exemplary embodiment, exemplary embodiments are not limited thereto. In other words, the first belt 240 according to an exemplary embodiment may be a general flat belt, a V-belt, etc.

The first rotation support unit 250 is installed to rotate relative to the first assembly fixing unit 210, and has a hollow shape.

On the external surface of a lower portion of the first rotation support unit 250, a first follower pulley unit 251 is installed. In the present exemplary embodiment, the first belt 240 is a timing belt, and thus a timing belt pulley is used as the first follower pulley 251. Since the first follower pulley unit 251 is installed with the first belt 240 wound around it, the first rotation support unit 250 rotates as the first belt 240 rotates.

On an upper portion of the first rotation support unit 250, the rotation support assembly 300, which will be described later, is installed.

Meanwhile, the first rotation axis unit 260 is fixedly installed in the first assembly fixing unit 210, and supports the first rotation support unit 250 to be rotatable.

The first slip ring 270 is a device for preventing the twist of a cable C, and a slip ring of the related art may be used.

Meanwhile, the above-described constitution of the rotation support assembly 200 for panning is applied as it is to the rotation support assembly 300 for tilting.

In other words, as shown in FIG. 2, the rotation support assembly 300 for tilting performs a function of supporting the camera module 100 so that the camera module 100 may rotate about the x-axis. The rotation support assembly 300 for tilting includes a second assembly fixing unit 310, a second drive motor 320, a second drive pulley (not shown), a second belt 340, a second rotation support unit 350, and a second rotation axis unit 360. Since the above-described configurations of the first assembly fixing unit 210, the first drive motor 220, the first drive pulley 230, the first belt 240, the first rotation support unit 250, and the first rotation axis unit 260 may be applied as they are to the second assembly fixing unit 310, the second drive motor 320, the second drive pulley (not shown), the second belt 340, the second rotation support unit 350, and the second rotation axis unit 360 respectively, the detailed descriptions thereof will be omitted.

However, while the first assembly fixing unit 210 is fixedly installed in the body 12, the second assembly fixing unit 310 is fixedly installed on the upper surface of the first rotation support unit 250.

The cover assembly 400 may be installed on the first rotation support unit 250. Here, the cover assembly 400 may include a first cover assembly 410 that is fixed to the first rotation support unit 250 and rotates during the pan rotation (i.e., the panning motion) of the first rotation support unit 250. Also, the cover assembly 400 may include a second cover assembly 420 that is fixed to the second rotation support unit 350 and rotates during the tilt rotation (i.e., the tilting motion) of the second rotation support unit 350.

One side of the first cover assembly 410 may be formed to be open. In the opening of the first cover assembly 410, the second cover assembly 420 may be installed to be slidable. The second cover assembly 420 may have a transmission portion that is formed to be transparent so that imaging light incident from the outside of the surveillance camera system 10 may pass through the transmission portion.

Meanwhile, the shield unit 14 may move along the surface of the dome cover 11 according to a selection. Here, the shield unit 14 may be formed to be similar to the dome cover 11. For example, the shield unit 14 may be formed in a hemispherical shape whose upper portion is opened when the dome cover 11 is formed in the hemispherical shape. Alternatively, the shield unit 14 may be formed in a plate shape to shield only a specific portion of the dome cover 11. However, the shape of the shield unit 14 is not limited thereto and may be formed in a variety of shapes. For example, the shield unit 14 may be formed in a net shape, a grid shape, a plate shape, a ring shape, a band shape, etc. That is to say, the shield unit 14 may have any shape that shields at least a portion of the dome cover 11 by moving. However, for convenience of description, an exemplary embodiment in which the shield unit 14 is formed in a ring shape will be mainly described in further detail below.

The shield unit 14 may be disposed outside or inside the dome cover 11. However, for convenience of description, an exemplary embodiment in which the shield unit 14 is disposed inside the dome cover 11 will be mainly described in further detail below.

The shield unit 14 may be formed of a variety of materials. For example, the shield unit 14 may be formed of an elastic material, such as rubber or silicone, or a synthetic resin, such as plastic. However, for convenience of description, an exemplary embodiment in which the shield unit 14 is formed of an elastic material, such as rubber or silicone, will be mainly described in further detail below.

The shield unit 14 may move along the outer surface of the dome cover 11 according to operation of the shield driver 15. When the shield unit 14 moves, the shield unit 14 may shield at least one selected from the group consisting of the dome cover 11 and the imaging unit assembly 13 from the outside.

The shield driver 15 may be connected with the shield unit 14 and may selectively cause the shield unit 14 to move. For example, the shield driver 15 may have a rack gear 15*a* that is connected with the shield unit 14 to move the shield unit 14 in a linear motion. The shield driver 15 may also have a pinion gear 15*b* that is engaged with the rack gear 15*a*, and a driver 15*c* that is connected with the pinion gear 15*b* to rotate the pinion gear 15*b*. In another exemplary embodiment, the shield driver 15 may have a cylinder that is connected with the shield unit 14 and that has a variable length. In still another exemplary embodiment, the shield driver 15 may have a drive unit (not shown) that makes a rotary motion, such as a motor, a cam (not shown) that is connected to the drive unit to rotate, a shaft (not shown) that is connected to the cam to make a reciprocating linear motion, and a guide unit (not shown) that guides the shaft. The shield driver 15 is not limited to the exemplary embodiments mentioned above, and may have any structure or device that cause the shield unit 14 to move in a linear motion. However, for convenience of description, an exemplary embodiment in which the shield driver 15 has the rack gear 15*a*, the pinion gear 15*b*, and the driver 15*c* will be mainly described in further detail below.

The sensor unit 16 may sense a variety of information. For example, the sensor unit 16 may sense whether or not an external life (e.g., a person) approaches the surveillance camera system 10, whether or not the surveillance camera system 10 falls, whether or not an impact is exerted on the dome cover 11, a voice signal input from the outside, etc.

The sensor unit 16 may have a laser sensor (not shown), an optical sensor (not shown), an ultrasonic sensor (not shown), an infrared sensor (not shown), etc. that senses whether or not an external life approaches. The sensor unit 16 may have a gyro sensor (not shown), an acceleration sensor (not shown), etc. that senses whether or not the surveillance camera system 10 falls, or an impact exerted on the dome cover 11. Also, the sensor unit 16 may have a voice recognition sensor (not shown) that senses a voice signal input from the outside.

Based on a value measured by the above-described sensor unit 16, the shield driver 15 may operate to move the shield unit 14. For example, the shield driver 15 may operate based on a value determined by the controller 17, and may also be directly operated according to the value measured by the sensor unit 16. In the both cases, control methods and signal processing methods are identical or similar, and thus a case in which the controller 17 determines whether or not to operate the shield driver 15 and operates the shield driver 15 after the value measured by the sensor unit 16 is transmitted to the controller 17 will be mainly described in further detail below.

The alarm 19 may output an alarm to the outside based on the value sensed by the sensor unit 16. The alarm 19 may have any structure that output an alarm to the outside.

Operation of the surveillance camera system 10 will be described in further detail below.

Figure 6:
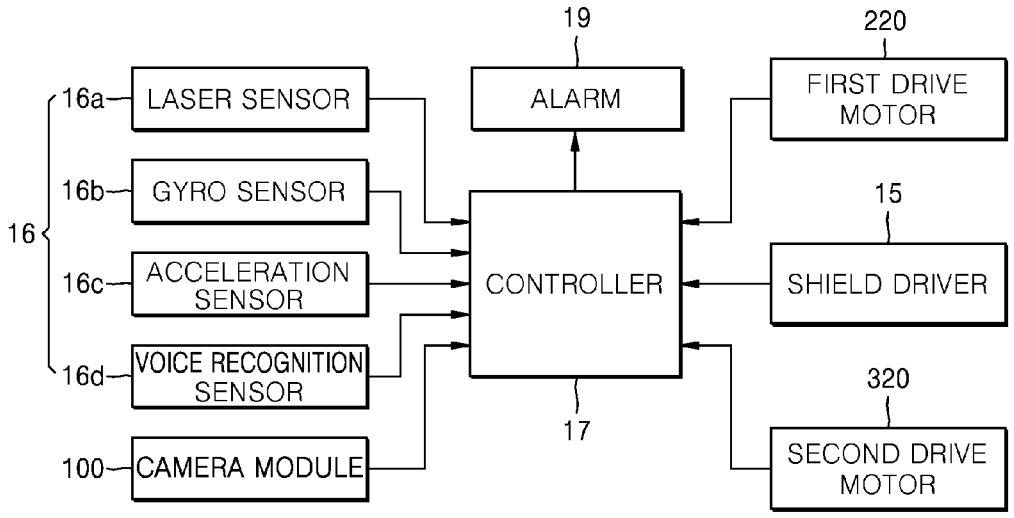
FIG. 6 is a block diagram showing control flow of the surveillance camera system shown in FIG. 1.

FIG. 6 is a block diagram showing control flow of the surveillance camera system shown in FIG. 1.

Referring to FIG. 6, in a general situation, the surveillance camera system 10 may acquire an outside video through the camera module 100. At this time, the controller 17 may cause the camera module 100 to perform at least one operation selected from the group consisting of a tilting operation and a panning operation by controlling at least one selected from the group consisting of the first drive motor 220 and the second drive motor 320, thus moving the camera module 100.

While operating as mentioned above, the controller 17 may operate the surveillance camera system 10 according to a previously set control sequence and control flow. When there is a danger of damage to the surveillance camera system 10 during operation of the surveillance camera system 10, the controller 17 may operate the shield driver 15. Control flow and a control method will be described in further detail below according to each case. However, these cases are merely exemplary and exemplary embodiments are not limited thereto.

First, according to an operation method of the shield driver 15 based on whether or not an external life approaches, the sensor unit 16 may sense whether or not an external life approaches and transmit the sensed information to the controller 17. As described above, the sensor unit 16 may have a laser sensor 16*a*, an optical sensor (not shown), an ultrasonic sensor (not shown), an infrared sensor (not shown), etc. In the both cases of the sensor unit 16 having the laser sensor 16*a* and the sensor unit 16 having the optical sensor, the ultrasonic sensor, or the infrared sensor, the surveillance camera system 10 may operate identically or similarly, and thus, for convenience of description, an exemplary embodiment in which the sensor unit 16 has the laser sensor 16*a* will be mainly described in further detail below.

The laser sensor 16*a* may measure the distance from an external life and transmit the measured distance to the controller 17. At this time, the controller 17 may determine whether or not the external life approaches by comparing the measured distance from the external life with a previously set distance.

Specifically, when it is determined that the distance between the external life and the laser sensor 16*a* is the same as or exceeds the previously set distance, the controller 17 may determine that the external life does not come closer.

On the other hand, when it is determined that the distance between the external life and the laser sensor 16*a* is less than the previously set distance, the controller 17 may determine that the external life approaches. At this time, the controller 17 may operate the shield driver 15. Specifically, the controller 17 may rotate the pinion gear 15*b* by operating the driver 15*c*. The rotation of the pinion gear 15*b* may cause the rack gear 15*a* to move in a linear motion. Accordingly, because the shield unit 14 is connected to the rack gear 15*a*, the shield unit 14 is caused to move in a linear motion by the rack gear 15*a*, thereby shielding at least a portion of the dome cover 11. In other words, the shield unit 14 may move along the surface of the dome cover 11 to a portion in which the camera module 100 is disposed. For example, in the present exemplary embodiment, the shield unit 14 may shield the portion of the dome cover 11 corresponding to the camera module 100.

Therefore, the surveillance camera system 10 may prevent damage or failure of the camera module 100 that may be caused when an external life approaches or collides with the surveillance camera system 10.

Meanwhile, when the sensor unit 16 determines whether or not the surveillance camera system 10 falls, the sensor unit 16 may have a sensor capable of measuring an angular speed, a speed, or an acceleration of the surveillance camera system 10, such as a gyro sensor 16*b* or an acceleration sensor 16*c*, as mentioned above. In the both cases of the sensor unit 16 having the gyro sensor 16*b* and the sensor unit 16 having the acceleration sensor 16*c*, the surveillance camera system 10 may be controlled identically or similarly, and thus an exemplary embodiment in which the sensor unit 16 has the acceleration sensor 16*c* will be mainly described in further detail below for convenience of description.

When the surveillance camera system 10 falls, the acceleration sensor 16*c* may measure the acceleration of the falling surveillance camera system 10 and transmit the measured acceleration to the controller 17. At this time, the controller 17 may determine whether or not the measured acceleration is equal to or greater than a previously set acceleration.

When it is determined that the measured acceleration is less than the previously set acceleration, the controller 17 may not operate the shield driver 15. On the other hand, when it is determined that the measured acceleration is equal to or greater than the previously set acceleration, the controller 17 may operate the shield driver 15. When the shield driver 15 operates in this way, the shield unit 14 may move to shield at least a portion of the dome cover 11 in the same or similar way to the above description.

Therefore, when the surveillance camera system 10 falls, the shield unit 14 may be operated so that the shield unit 14 absorbs the impact of collision with the ground for example. Consequently, it is possible to prevent damage or failure of the camera module 100.

Meanwhile, when an impact is exerted on the dome cover 11, the surveillance camera system 10 may operate in the same or similar way to the case where the surveillance camera system 10 falls. At this time, the sensor unit 16 may have the gyro sensor 16*b* or the acceleration sensor 16*c* as mentioned above. For convenience of description, an exemplary embodiment in which the sensor unit 16 has the gyro sensor 16*b* will be mainly described in further detail below.

Specifically, when an impact is exerted on the surveillance camera system 10 by an object, such as a tool, an implement, a stone, etc., the gyro sensor 16*b* may sense the impact. At this time, the gyro sensor 16*b* may transmit a value of the sensed impact to the controller 17. Then, the controller 17 may determine whether or not the received impact value is equal to or greater than a previously set impact value.

When it is determined that the received impact value is less than the previously set impact value, the controller 17 may maintain a current state and acquire an outside video through the camera module 100. On the other hand, when it is determined that the received impact value is equal to or greater than the previously set impact value, the controller 17 may operate the shield driver 15 to move the shield unit 14. Since the operation of the shield driver 15 and the motion of the shield unit 14 are the same as or similar to the description above, the detailed description will be omitted.

When the shield unit 14 operates as described above, the shield unit 14 may shield at least a portion of the dome cover 11.

Therefore, when an impact is exerted on the surveillance camera system 10, it is possible to prevent damage or failure of the surveillance camera system 10 resulting from the external impact by operating the shield unit 14.

In addition to the above cases, when a voice signal is input from the outside, the controller 17 may operate the shield driver 15. For example, when a voice signal of a passerby, a guard, etc. is input, the sensor unit 16 may receive the voice signal. At this time, the sensor unit 16 may have a voice recognition sensor 16*d* mentioned above.

When the voice signal is input as mentioned above, the voice recognition sensor 16*d* may transmit the recognized voice signal to the controller 17. Then, the controller 17 may determine whether or not the recognized voice signal is the same as a previously set voice signal. For example, the previously set voice signal may be a specific word, such as "shield", "number one", or "danger", or a sentence, such as "operate the shield unit" or "protect the camera module".

When it is determined that the recognized voice signal is the same as the previously set voice signal, the controller 17 may operate the shield driver 15 to move the shield unit 14. Since the operation of the shield driver 15 and the motion of the shield unit 14 are the same as or similar to the description above, the detailed description will be omitted.

Therefore, when a voice signal is input from the outside, the surveillance camera system 10 may protect itself by using the shield unit 14 before or upon harm to the surveillance camera system 10.

In addition to the above cases, the surveillance camera system 10 may operate the shield driver 15 by using a video acquired through the camera module 100.

Specifically, when a video is acquired by the camera module 100, the acquired video may be transmitted to the controller 17. At this time, videos or data of dangerous objects may have been set in advance in the controller 17. For example, in the controller 17, data of fixed types of dangerous objects, such as a hammer, an axe, and a gas tank, may be set in advance. Also, in the controller 17, data of non-fixed types of dangerous objects, such as a stone and a flame, may be set in advance.

In this case, the data of sizes, types, colors, etc. of dangerous objects may be set in advance in the controller 17. Then, the controller 17 may analyze an image or a video acquired by the camera module 100 based on such information.

In addition, the controller 17 may determine whether or not a dangerous object approaches by determining whether or not an image or a video acquired by the camera module 100 changes in size. For example, when the number of pixels occupied by a dangerous object in an image acquired by the camera module 100 increases, the controller 17 may determine that the dangerous object approaches. At this time, when a change in the number of pixels is equal to or greater than a predetermined value, the controller 17 may determine that the dangerous object approaches.

The controller 17 analyzes the image or the video acquired by the camera module 100, and may operate the shield driver 15 when it is determined that the analyzed image or video corresponds to the previously set data and a dangerous object approaches. An operation method of the shield driver 15 may be the same as or similar to the above description, and thus the detailed description will be omitted.

In addition to the above cases, the controller 17 may simultaneously use the method of analyzing an image or a video acquired by the camera module 100 to operate the shield driver 15, and the above-described method of operating the shield driver 15 by using a value sensed by the sensor unit 16.

Therefore, the surveillance camera system 10 may block an external impact that causes damage or failure of the surveillance camera system 10 with the shield unit 14, so that the surveillance camera system 10 may be protected.

Meanwhile, when the sensor unit 16 senses danger as described above, the controller 17 may operate the alarm 19. Specifically, when the controller 17 operates the shield driver 15 in the above-described situation, it is possible to output an alarm to a user through the alarm 19. At this time, the alarm 19 may output the alarm including a sound, a light, a video, an image, etc. to the outside.

Therefore, the surveillance camera system 10 may rapidly and correctly sense external danger and prevent failure and damage to itself.

As described above, according to the one or more of the above exemplary embodiments, it is possible to prevent damage to a surveillance camera system.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope of the present inventive concept as defined by the following claims.

What is claimed is:

1. A surveillance camera, comprising:

an imaging assembly;

a dome cover comprising a transparent portion and formed to surround the imaging unit assembly;

a shield configured to move along a surface of the dome cover;

a shield driver configured to control the shield; and a sensor configured to sense a value corresponding to at least one of whether an object is approaching the surveillance camera, whether the surveillance camera is falling, whether an impact is exerted on the dome cover, and whether a voice signal is input from outside of the surveillance camera, wherein the sensed value is compared with a preset value, and wherein the shield driver is further configured to control the shield to shield at least a portion of the dome cover based on a result of the comparing.

2. The surveillance camera of claim 1, wherein the shield driver comprises:

a rack gear connected with the shield;

a pinion gear engaged with the rack gear and configured to rotate; and a driver connected with the pinion gear and configured to rotate the pinion gear.

3. The surveillance camera of claim 1, wherein the shield driver is further configured to control the shield to shield at least a portion of the dome cover in response to the sensed value being equal to or greater than the preset value.

4. The surveillance camera of claim 1, further comprising an alarm configured to output an alarm to the outside based on the sensed value.

5. The surveillance camera of claim 1, wherein the sensor comprises a laser sensor configured to sense whether the object is approaching the surveillance camera.

6. The surveillance camera of claim 1, wherein the shield is formed of an elastic material.

7. The surveillance camera of claim 1, wherein the shield is formed in a ring shape.

8. The surveillance camera of claim 1, further comprising a controller configured to store the preset value, compare the sensed value with the preset value, and control the shield driver based on the result of the comparing.

9. A surveillance camera, comprising:

an imaging assembly;

a dome cover comprising a transparent portion and formed to surround the imaging assembly;

a shield configured to move along a surface of the dome cover; and a shield driver configured to control the shield to shield at least a portion of the dome cover based on a result of comparing data acquired by the imaging assembly with preset data, wherein the preset data comprises at least one of an object approaching the camera, the camera failing, an impact exerted on the dome cover, and a received voice command.

10. The surveillance camera of claim 9, wherein the shield is formed of an elastic material.

11. The surveillance camera of claim 9, wherein the shield is formed in a ring shape.

12. The surveillance camera of claim 9, further comprising a controller configured to store the preset data, compare the data acquired by the imaging assembly with the preset data, and control the shield driver based on the result of the comparing.

13. A method of protecting a surveillance camera, the method comprising:

generating data by at performing at least one of:

photographing an area in which the surveillance camera is disposed; and sensing at least one of whether an object is approaching the surveillance camera, whether the surveillance camera is falling, whether an impact is exerted on a dome cover of the surveillance camera, and whether a voice signal input from the area in which the surveillance camera is disposed;

comparing the generated data with preset data; and in response to the generated data being equal to or greater than the preset data, operating a shield driver to protect the dome cover with a shield.

14. The method of claim 13, wherein the generated data selected from the group consisting of an acquired image, an acquired video, an acceleration value, an angular speed, a speed value, an impact value, and a voice signal.

15. A camera comprising:

a camera module;

a shield configured to protect the camera module; and a controller configured to control the shield to protect the camera module in response to determining that a predetermined event occurs;

a dome cover comprising a transparent portion and formed to surround the camera module; and a shield driver configured to move the shield based on a signal received from the controller, wherein the predetermined event comprises at least one of an object approaching the camera, the camera falling, an impact exerted on the dome cover, and a received voice command.

16. The camera of claim 15, wherein the shield is configured to move along the dome cover.

17. The camera of claim 16, where the shield is formed of an elastic material.

* * * * *